US005113834A

United States Patent [19]

Aramaki

[11] Patent Number: 5,113,834

[45] Date of Patent: May 19, 1992

[54] SELF-DIAGNOSING FUEL-PURGING SYSTEM USED FOR FUEL PROCESSING SYSTEM

[75] Inventor: Takashi Aramaki, Kanagawa, Japan

[73] Assignee: Nissan Motor Company, Limited, Yokohama, Japan

[21] Appl. No.: 707,138

[22] Filed: May 31, 1991

[30] Foreign Application Priority Data

May 31, 1990 [JP] Japan ..... 2-139667

[51] Int. Cl.[5] ..... F02N 33/02; F02B 77/00

[52] U.S. Cl. ..... 123/520; 123/198 D

[58] Field of Search ..... 123/518, 519, 520, 521, 123/198 D, 516

[56] References Cited

U.S. PATENT DOCUMENTS

| | | | |
|---|---|---|---|
| 4,598,686 | 7/1986 | Lupoli | 123/519 |
| 4,748,959 | 6/1988 | Cook | 123/520 |
| 4,867,126 | 9/1989 | Yonekawa | 123/198 D |
| 4,949,695 | 8/1990 | Uranishi | 123/198 D |
| 4,962,744 | 10/1990 | Uranishi | 123/198 D |

FOREIGN PATENT DOCUMENTS

| | | | |
|---|---|---|---|
| 0020753 | 2/1981 | Japan | 123/518 |
| 0065244 | 4/1985 | Japan | 123/520 |
| 0007962 | 1/1987 | Japan | 123/519 |
| 0190955 | 8/1989 | Japan | 123/519 |
| 0108843 | 4/1990 | Japan | 123/519 |

*Primary Examiner*—Carl Stuart Miller
*Attorney, Agent, or Firm*—Foley & Lardner

[57] ABSTRACT

A self-diagnosing fuel-purging system includes a plurality of temperature sensors for detecting temperatures of an adsorbent in a fuel processing apparatus at different points. The system causes fuel previously adsorbed onto the adsorbent to be purged, and then, determines the state of the fuel adsorbed onto the adsorbent on the basis of the temperatures detected by means of the temperature sensors while fuel-purging is stopped. After the state of the fuel adsorbed onto the adsorbent becomes a predetermined state, the system determines abnormality in itself on the basis of temperature drop of the adsorbent detected by at least one of the temperature sensors while performing fuel-purging.

6 Claims, 3 Drawing Sheets

SELF-DIAGNOSING FUEL-PURGING SYSTEM USED FOR FUEL PROCESSING SYSTEM

BACKGROUND OF THE INVENTION

1. Field of The Invention

The present invention relates generally to a fuel-purging system used for a fuel processing system which processes vaporized fuel in a fuel tank before the fuel is introduced into an internal combustion engine of, for example, an automotive vehicle. More specifically, the invention relates to a self-diagnosing fuel-purging system which can detect abnormality in itself.

2. Description of The Background Art

Japanese Patent Second (examined) Publication (Tokko Sho.) No. 53-19729 discloses a fuel-purging system used for a fuel processing system which processes vaporized fuel in a fuel tank. In this system, when the pressure within the fuel tank becomes a positive pressure greater than a predetermined value, the vaporized fuel in the fuel tank is introduced into a canister packed with an adsorbent, such as activated carbon, to be adsorbed onto the adsorbent. Then, the adsorbed fuel is removed from the adsorbent to be supplied to an engine through a purging passage. The purging passage is provided with a diaphragm valve which is controlled to be open and closed in accordance with negative throttle pressure. This diaphragm valve is suitably controlled so that fuel-purging is performed in a predetermined fuel-purging condition.

In such a fuel processing system, when the purging passage is clogged or if leaks are present, normal fuel-purging can not be performed. In order to assure reliability of the system, it is desirable that the system be self-diagnosing.

In conventional fuel-purging systems, abnormality is determined on the basis of variation of temperature of the adsorbent. The reason for this is that temperature of the adsorbent increases when vaporized fuel is charged or adsorbed thereon, and decreases when the adsorbed fuel is purged therefrom. Therefore, in conventional fuel-purging systems, abnormality is determined by detecting temperature rise of the adsorbent in a fuel-purging prevented condition in which fuel-purging is prevented, and temperature drop of the adsorbent in a fuel-purging condition in which fuel-purging is performed.

However, since switching between the fuel-purging condition and the fuel-purging prevented condition is performed independently of a charging or purging condition of the adsorbent, in the fuel-purging condition the amount of fuel adsorbed before fuel-purging starts to be performed, can not be determined. In addition, since there is little temperature drop when the amount of adsorbed fuel is very small, it is impossible to determine abnormality of the system even if it is determined that there is no temperature drop after fuel-purging starts to be performed.

Accordingly, it is required that abnormality of the system be diagnosed in a condition in which the vaporized gas is adsorbed onto the adsorbent to some degree. In order to accomplish this, an improved process has been proposed. In this process, fuel-purging is stopped for a predetermined period of time before diagnosing, and then, abnormality of the system is diagnosed after determining whether or not vaporized fuel is adsorbed onto the adsorbent on the basis of temperature rise of the adsorbent.

However, if this process is used, since there is little temperature rise of the adsorbent after the fuel is adsorbed onto the adsorbent to some degree, temperature rise can not be detected when the vaporized fuel is adsorbed onto a detected portion of the adsorbent in the initial stage after fuel-purging is performed, or when adsorbing power of the adsorbent is partially lost due to deterioration of adsorbing power of the adsorbent, in an older or used system, for example. In this case, the adsorbing performance can not be determined.

SUMMARY OF THE INVENTION

It is therefore a principal object of the present invention to eliminate the aforementioned disadvantages and to provide a fuel-purging system used for a fuel processing system, which fuel-purging system can accurately detect adsorbed condition of vaporized fuel before fuel-purging, to accurately diagnose abnormality in itself.

It is another object of the present invention to to provide high-reliability for the aforementioned self-diagnosing fuel-purging system.

In order to accomplish the aforementioned and other objects, a fuel-purging system includes first and second temperature detecting means for detecting temperatures of an adsorbent in a fuel processing apparatus at upper and lower portions. The system may cause a fuel previously adsorbed onto the adsorbent to be purged, and then, determine the state of the fuel adsorbed onto the adsorbent on the basis of the temperatures detected by means of the first and second temperature detecting means while stopping fuel-purging. After the state of the fuel adsorbed onto the adsorbent becomes a predetermined state, the system may determine abnormality in itself on the basis of temperature drop of the adsorbent detected by at least one of the first and second temperature detecting means while performing fuel-purging.

According to one aspect of the present invention, a diagnosing system for a fuel-purging system comprises: temperature detecting means for detecting temperature of an adsorbent at a plurality of locations in a fuel processing apparatus; and discriminating means for determining the state of a fuel adsorbed onto the adsorbent on the basis of the temperatures detected by the temperature detecting means, and for determining abnormality of the fuel-purging system on the basis of temperature drop of the adsorbent detected at least location by the temperature detecting means after the state of the adsorbed fuel assumes a predetermined state.

According to another aspect of the present invention, a fuel-purging system for processing a fuel to be supplied to an engine via an intake manifold, comprises: a fuel processing apparatus for receiving a fuel from a fuel tank, the fuel processing apparatus being packed with an adsorbent for adsorbing the fuel thereon; a fluid passage for establishing a fluid communication between the fuel processing apparatus and the intake manifold; valve means for selectively opening and closing the fluid passage; first temperature detecting means for detecting temperature of the adsorbent at an upper portion of the fuel processing apparatus; second temperature detecting means for detecting temperature of the adsorbent at a lower portion of the fuel processing apparatus; discriminating means for determining the state of the fuel adsorbed onto the adsorbent on the basis of the temperatures detected by the first and second temperature detecting means while the valve means closes the fluid passage, and for determining abnormality of the fuel-purging system on the basis of temperature drop of the adsorbent detected by at least one of the first and second temperature detecting means while the valve means opens the fluid passage after the state of the adsorbed fuel becomes a predetermined state.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Figure 1:
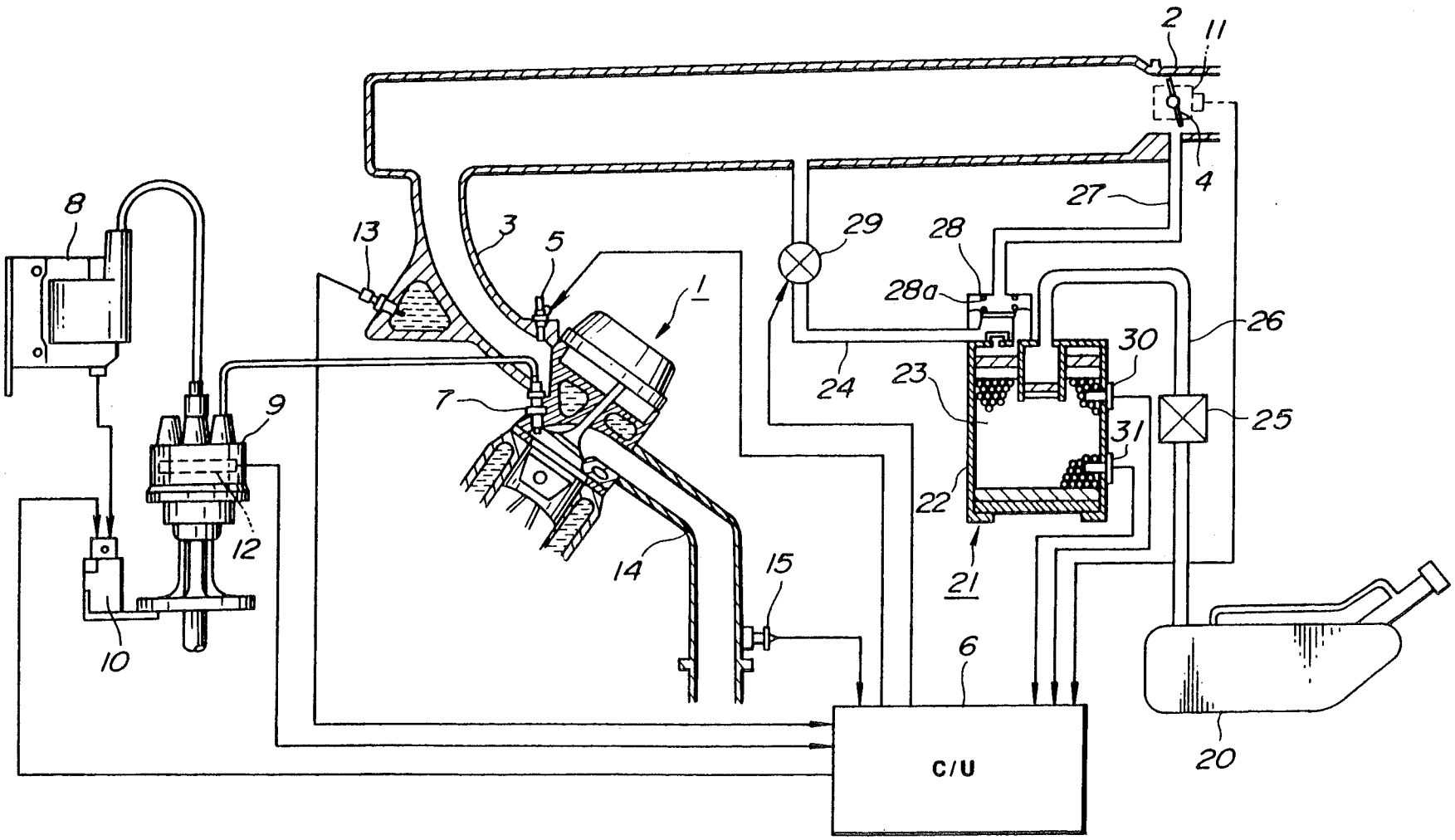
FIG. 1 is a schematic diagram of a fuel-purging system according to the present invention.

Referring now to the drawings, particularly to FIG. 1, there is shown the preferred embodiment of a fuel processing system for processing a fuel introduced into an engine 1, according to the present invention.

In this system, air is designed to be introduced into the engine 1 through a throttle chamber 2 and an intake manifold 3. The throttle chamber 2 has a throttle valve 4 which is opened via application of an accelerator pedal (not shown) to control intake air flow rate Q. The intake manifold 3 has electromagnetic fuel injection valves 5 in its respective cylinders. The electromagnetic fuel injection valves 5 serve to inject fuel, which is pressurized by a fuel pump (not shown) to be controlled at a predetermined pressure by means of a pressure regulator (not shown), into the intake manifold 3. The amount of fuel injected by the fuel injection valves 5 is controlled by means of a control unit 6 having a microcomputer.

The respective cylinders of the engine 1 are provided with ignition plugs 7, to which high voltage produced by an ignition coil 8 is applied in a specified order via a distributor 9, so that an air/fuel mixture in the respective cylinders is ignited. The timing for applying the high voltage produced by the ignition coil 8 is controlled by means of a power transistor 10.

The throttle valve 4 is provided with a throttle sensor 11 for detecting the opening angle TVO of the throttle valve 4 by means of a potentiometer. The distributor 9 has a crank angle sensor 12 for monitoring angular position of a crankshaft to produce a detection signal at every predetermined crank angle.

As will be described hereinafter, a steady running state of the engine 1 is detected on the basis of the detection signals produced by the throttle sensor 11 and the crank angle sensor 12.

In addition, an engine coolant temperature sensor 13 is disposed within an engine coolant jacket for detecting an engine coolant temperature Tw, and an oxygen sensor 15 is disposed within an exhaust manifold 14 for detecting an oxygen concentration in exhaust gas which is closely related with an air/fuel ratio of an air/fuel mixture introduced into the engine 1.

Furthermore, a fuel-purging system 21 is provided for processing fuel introduced from a fuel tank 20 into the engine 1. The fuel-purging system 21 has a canister 22 packed with an adsorbent 23, such as an activated carbon. The vaporized fuel within the fuel tank 20 is adsorbed onto the adsorbent 23, and then, the adsorbed fuel is supplied to the intake passage downstream of the throttle valve 4 through a purging passage 24.

A check valve 25 is arranged within a vaporized fuel passage 26 which communicates the canister 22 with the fuel tank 20. When a positive pressure in the fuel tank 20 becomes greater than a predetermined value, the check valve 25 is designed to open, to allow the vaporized fuel within the fuel tank to be introduced into the canister 22. Also, a diaphragm valve 28 is arranged between the canister 22 and the purging passage 24. The diaphragm valve 28 has a pressure chamber, to which a negative throttle pressure is supplied via a negative pressure introducing passage 27.

The diaphragm valve 28 is designed to open the purging passage 24 against the biasing force of a spring 28*a* when a negative throttle pressure greater than a predetermined value is applied thereto due to rotation of the engine 1, and to close the purging passage 24 by the biasing force of the spring 28*a* when the negative throttle pressure becomes less than the predetermined value or equal to an atmospheric pressure during a time in which the engine 1 is stopped, so that fuel-purging is performed only under a suitable fuel-purging condition (a condition in which the engine 1 rotates, in the preferred embodiment of the present invention).

A normally open type solenoid valve 29, which is controlled to be open and closed by means of the control unit 6, is arranged within the purging passage 24 downstream of the diaphragm valve 28. In addition, the canister 22 is provided with canister temperature sensors 30 and 31 for monitoring temperatures within the canister 22 (temperatures of the adsorbent 23) at upper and lower positions, respectively.

The control unit 6 controls a fuel injection amount and an ignition timing performed by the fuel ignition valve 5, on the basis of detection signals produced from various sensors. The control unit 6 also performs the self-diagnosing of the fuel-purging system as well as the opening and closing control of the solenoid valve 29.

Figure 2:
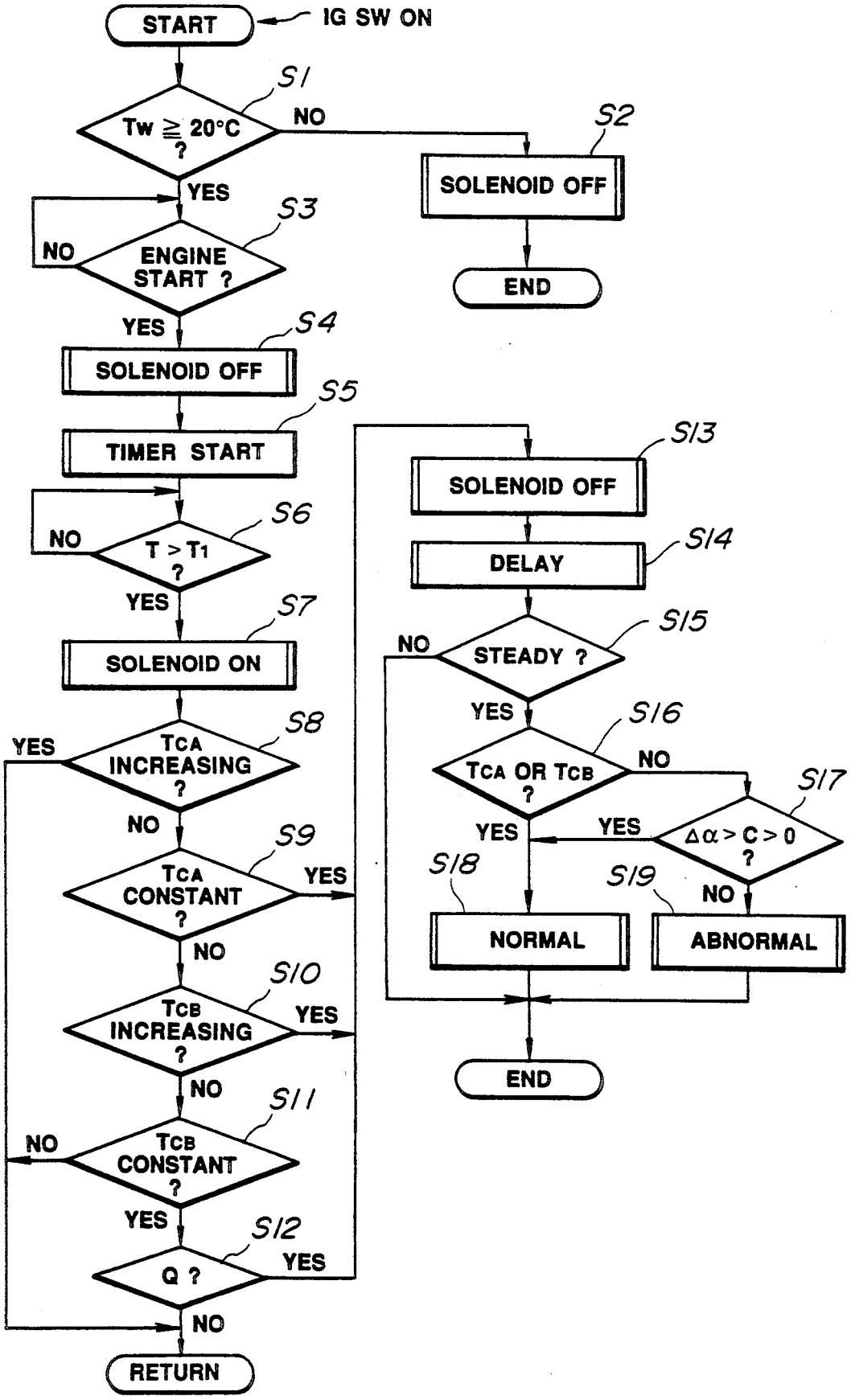
FIG. 2 is a flow chart showing a process for determining abnormality in the fuel-purging system of FIG. 1.

A self-diagnosing control process performed by the fuel-purging system, according to the present invention, is described in a flow chart of FIG. 2.

The program of the flow chart of FIG. 2 is executed when an ignition switch (IGSW) becomes ON. At step 1, it is determined whether or not the engine coolant temperature Tw detected by the engine coolant temperature sensor 13 is greater than a predetermined temperature (e.g. 20° C.).

When outside air temperature is relatively low, the engine coolant temperature is less than the predetermined temperature at engine start-up, and little fuel may be vaporized. In this condition, self-diagnosing can not be accurately performed in accordance with the self-diagnosing process of the present invention. Therefore, the routine goes to step 2 in which the routine ends while the solenoid valve 29 is maintained open (OFF).

On the other hand, it is determined that the engine coolant temperature Tw is greater than the predetermined temperature, the routine goes to step 3 in which it is determined whether or not the engine 1 has started.

This determination is repeated until the engine 1 starts to rotate. During this determination, fuel-purging is not performed since, although the solenoid valve 29 is maintained open, the diaphragm valve 28 is designed to be open when the negative throttle pressure becomes greater than a predetermined value if the engine 1 is rotating.

After the engine 1 starts to rotate, when the diaphragm valve 28 is opened to perform fuel-purging through the diaphragm valve 28 and the solenoid valve 29, the routine goes to step 4 in which a command for maintaining the solenoid valve 29 at its open position (OFF) is produced, and then, the routine goes to step 5 in which a timer T for measuring fuel-purging period of time is started from zero.

Then, at next step 6, it is determined whether or not the fuel-purging period of time T measured by the timer T exceeds a predetermined period of time $T_1$. This determination is repeated until fuel-purging is performed for the predetermined period of time $T_1$. In this way, by performing fuel-purging for the predetermined period of time $T_1$ immediately after the engine starts up, previously adsorbed fuel is purged or removed, so that re-adsorbing can be performed when the purging passage 24 is next closed.

Figure 3:
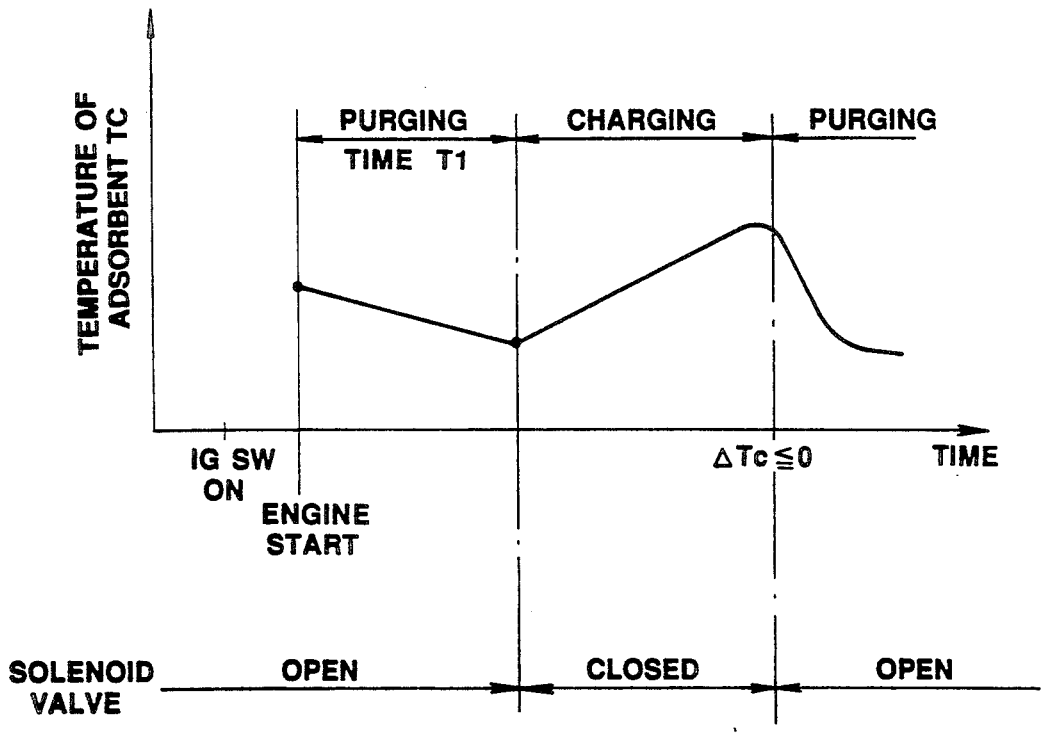
FIG. 3 is a timing chart showing control characteristics of the fuel-purging system of FIG. 1.

When fuel-purging is performed for the predetermined period of time $T_1$, the routine goes from step 6 to step 7 in which electrical current is applied to the solenoid valve 29, i.e. the solenoid valve 29 is turned ON, so that the solenoid valve 29 is maintained at its closed position until the next command for maintaining the solenoid valve 29 at its open position (OFF) is produced (See FIG. 3).

In this way, when the purging passage 24 is closed by the solenoid valve 29, the routine goes to step 8 in which it is determined whether or not a temperature $T_{CA}$ detected by the upper canister temperature sensor 30 is increasing while the solenoid valve 29 is closed, by determining whether or not a variation $\Delta T_{CA}$ of the temperature $T_{CA}$ for unit time is greater than or equal to a predetermined positive value $\Delta T_O$.

When the temperature $T_{CA}$ is increasing, it means that fuel adsorbing is insufficient. In this case, the solenoid valve 29 remains in the closed position. On the other hand, when it is determined that the temperature $T_{CA}$ is not increasing, the routine goes to step 9.

At step 9, it is determined whether the temperature $T_{CA}$ is substantially constant or slightly decreasing after it increases. When the temperature $T_{CA}$ is slightly decreasing, it may mean that temperature increase has not started due to a low degree of adsorption, but may also indicate that the temperature has not varied from start up due to deterioration of the sensor 30 or such like.

When it is determined that the temperature $T_{CA}$ is substantially constant after it increases, it is assumed that amount of adsorbed fuel is sufficient to diagnose abnormality of the system, and the routine goes to step 13 in which electrical current to the solenoid valve 29 is interrupted, to cause the purging passage 24 to be open so as to cause fuel-purging to start. On the other hand, when it is determined that the temperature $T_{CA}$ is slightly decreasing, amount of the adsorbed fuel is insufficient, or that the adsorption condition is unclear. In this case, the routine goes to step 10 in which it is determined whether or not temperature $T_{CB}$ detected by the lower canister temperature sensor 31 is increasing, by determining whether or not a variation $\Delta T_{CB}$ of the temperature $T_{CB}$ is greater than a predetermined positive value $\Delta T_O$.

When it is determined that the temperature $T_{CB}$ is increasing, it is assumed that the amount of adsorbed fuel is insufficient, and the routine goes to step 13 in which fuel-purging is caused to start.

When it is determined that the temperature $T_{CB}$ is not increasing at step 10, the routine goes to step 11 in which it is determined whether the temperature $T_{CB}$ is substantially constant or slightly decreasing after it increases.

When it is determined that the temperature $T_{CB}$ is substantially constant, it is assumed that adsorption has advanced deep in the canister 22 to become slightly excessive (Overflow Condition), and the routine goes to step 12. At step 12, it is determined whether or not the engine 1 operates in a predetermined engine running condition in which the the intake air flow rate is sufficiently great so that the variation of the air/fuel ratio is small if the amount of the purged fuel increases. When it is YES, the routine goes to step 13 in which the command for opening the solenoid valve 29 is produced to perform fuel-purging. When it is NO, the solenoid valve 29 remains closed to stop fuel-purging until the engine 1 assumes the predetermined engine running condition. As mentioned above, since fuel-purging begins when the temperature $T_{CB}$ of the lower portion of the canister 22 is increasing, overflow of adsorbed fuel can usually be prevented. Even if there is overflow of adsorbed fuel, a deteriorating influence on the engine running condition due to fuel-purging can be prevented by creating the aforementioned condition in which fuel-purging can be performed.

On the other hand, at step 11, when it is determined that the temperature $T_{CB}$ is slightly decreasing after it increases, it is assumed that little fuel is adsorbed, and the solenoid valve 29 is maintained at its closed position to prevent fuel-purging since diagnosing of the system can not be initiated.

In this way, after adsorbed fuel in the canister 22 increases sufficiently, fuel-purging is designed to be started for accurately diagnosing abnormality in the system.

After the solenoid valve 29 is controlled to open the purging passage 24, the routine goes to step 14 in which a predetermined delay period is counted. That is, period after fuel-purging to allow the temperature of the adsorbent 23 to vary (decrease), the routine goes to step 15.

At step 15, it is determined whether or not the engine 1 operates in a steady state condition. For example, when the variation of the opening angle TVO of the throttle valve detected by the throttle sensor 11 is substantially zero, and, variation of the engine revolution speed derived on the basis of the detection signal output from the crank angle sensor 12 is also substantially zero, it is assumed to be a steady state.

When it is determined that the engine 1 operates in the steady state, the routine goes to step 16. At this step, it is determined whether or not the temperature $T_C$ of the adsorbent 23 decreases at a rate greater than a predetermined rate while fuel-purging is performed.

Since fuel-purging starts to be performed at step 11 after it is predicted that the amount of the adsorbed fuel becomes sufficient, the temperature $T_C$ of the adsorbent 23 should be suddenly decreased due to fuel-purging. Therefore, when the temperature $T_C$ is not decreasing at a rate greater than the predetermined rate, fuel-purging may be abnormal. Even in this case, temperature drop advances from the upper portion to the lower portion of the canister 22 in accordance with the progress of fuel-purging.

Therefore, at step 16, it is determined whether or not either the temperature $T_{CA}$ or $T_{CB}$ of the upper or lower portion of the canister 22 exhibits decreasing. When it is determined that neither of the temperatures $T_{CA}$ nor $T_{CB}$ decrease, the routine goes to step 17 in which it is determined whether or not the air/fuel ratio detected by the oxygen sensor 15 varies to rich, in order to confirm whether or not the temperatures $T_{CA}$ or $T_{CB}$ exhibit no decrease due to abnormality of the fuel-purging system.

The oxygen sensor 15 which may be used for the fuel-purging system, according to the present invention, is disclosed in Japanese Patent First (unexamined) Publication (Tokkai Sho.) No. 60-36949. Such an oxygen sensor 15 may measure of oxygen concentration in a wide range on the basis of oxygen concentration in the atmosphere, its output becoming greater the lower oxygen concentration in exhaust gas relative to a reference concentration. Since the oxygen concentration decreases when the air/fuel ratio varies to rich, the oxygen sensor 15 indicates that the air/fuel ratio varies to rich when the output thereof increases.

Therefore, at step 17, it is determined whether or not an output $\alpha$ of the oxygen sensor 15 is increasing at a rate greater than a predetermined rate C. When the output $\alpha$ is increasing, it is assumed that the air/fuel ratio varies to rich due to fuel-purging, and it is determined that, although the temperature $T_C$ of the adsorbent 23 does not exhibit desirable variation, normal fuel-purging was actually performed. In this case, the routine goes to step 18 in which it is determined that the fuel-purging system in itself is normal.

Also, when it is determined that the temperature $T_C$ of the adsorbent 23 decreases desirably at step 16, the routine goes to step 18 in which it is determined that the fuel-purging system is normal. When fuel-purging is performed in a condition in which the amount of the adsorbed fuel onto the adsorbent is greater than a predetermined value, the temperature $T_C$ of the adsorbent 23 decreases. Therefore, normal condition of the fuel-purging system can be determined on the basis of such a temperature drop.

On the other hand, if it is determined that the output $\alpha$ does not exhibit that the air/fuel ratio varies to rich, the temperature $T_C$ of the adsorbent 23 does not decrease, and the air/fuel ratio does not become enriched due to fuel-purging, it is assumed that the purging passage 24 is stopped or the like so that the purged fuel is not supplied to the engine 1, and the routine goes to step 19 in which it is determined that the purging-system is abnormal (a detection signal representative of the abnormality of the system is produced). In this case, a warning lamp or the like for informing an engine or vehicle operator of the abnormality of the system may be activated. Such a warning lamp may be mounted on an instrument panel or the like.

Furthermore, in a case where a lean-rich type sensor which turns ON or OFF when the air/fuel ratio varies from lean to rich or from rich to lean across the stoichiometric value, is used as the oxygen sensor 15, it is not possible to determine whether or not the air/fuel ratio is varying to rich due to fuel-purging, on the basis of variation of the sensor output. However, in a case where the control unit 6 performs air/fuel ratio feedback correction control for controlling the fuel injection amount to approach the real air/fuel ratio to the stoichiometric value on the basis of output of the aforementioned lean-rich type oxygen sensor 15, it is possible to determine whether or not the air/fuel ratio is varying to rich due to fuel-purging, on the basis of the direction of the feedback control.

To be specific, in a case where a feedback correction coefficient for correcting the fuel injection amount is so controlled to be increased or decreased on the basis of whether the real air/fuel ratio is rich or lean of as detected by the oxygen sensor 15 relative to the stoichiometric value, it is possible to determine that the air/fuel ratio is varying to rich due to fuel-purging when the decreasing control period of time of the feedback correction coefficient becomes longer than a predetermined period of time.

In the shown embodiment, although the diaphragm valve 28 for opening and closing the purging passage 24 in accordance with negative throttle pressure, the purging passage 24 may be provided with only a normally-closed-type solenoid valve which turns ON in the fuel-purging condition, and self-diagnosing may be performed after the aforementioned solenoid valve is closed for a predetermined period of time to start fuel-purging.

In addition, although in the shown embodiment the diaphragm valve 28 closes the purging passage 24 only when the engine is stopped, the diaphragm valve 28 may also close the purging passage 24 when negative throttle pressure is relatively low, such as in an engine idling condition. In this case, after either the fuel-purging condition or the fuel-purging prevented condition is determined on the basis of the engine running condition, such as engine revolution speed or engine load, the solenoid valve 29 is closed for a predetermined period of time in the fuel-purging condition to perform self-diagnosing.

Futhermore, the canister may be provided with three canister temperature sensors at the upper, middle and lower positions to determine one of three adsorbed conditions including low, medium and great adsorbed conditions, to start fuel-purging.

As mentioned above, according to the present invention, when self-diagnosing of the system is performed on the basis of temperature drop of the adsorbent while fuel-purging is performed, fuel-purging is caused to start after it is determined that vaporized fuel greater than a predetermined level is surely adsorbed onto the adsorbent by detecting variations of temperatures of a plurality of positions in the canister.

Therefore, it is possible to improve the reliability of system self-diagnosis of the on the basis of temperature drop while fuel-purging is performed.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A diagnosing system for a fuel-purging system which causes a fuel to be introduced from a fuel tank into a fuel processing apparatus packed with an adsorbent for adsorbing the fuel thereon, and which causes the fuel adsorbed onto the adsorbent to be supplied to an engine through a fluid passage which is selectively open and closed. said diagnosing system comprising:

temperature detecting means for detecting the temperature of the adsorbent at a plurality of locations in said fuel processing apparatus: and discriminating means for determining the state of the fuel adsorbed onto the adsorbent on the basis of the temperatures detected by said temperature detecting means, and for determining abnormality of the fuel-purging system on the basis of temperature drop of the adsorbent detected at at least one location by said temperature detecting means after the state of the adsorbed fuel assumes a predetermined state.

2. A diagnosing system as set forth in claim 1, wherein said discriminating means determines the state of the fuel adsorbed onto the adsorbent while said fluid passage is closed.

3. A diagnosing system as set forth in claim 1, wherein said discriminating means determines abnormality of the fuel-purging system while said fluid passage is opened.

4. A diagnosing system as set forth in claim 1, wherein said discriminating means determines the state of the fuel adsorbed onto the adsorbent after said fluid passage is opened to cause previously adsorbed fuel to be purged for a predetermined period of time.

5. A fuel-purging system for processing a fuel to be supplied to an engine via an intake manifold, said system comprising:

a fuel processing apparatus for receiving a fuel from a fuel tank. said fuel processing apparatus being packed with an adsorbent for adsorbing the fuel thereon;

a fluid passage for establishing a fluid communication between said fuel processing apparatus and said intake manifold;

valve means for selectively opening and closing said fluid passage:

first temperature detecting means for detecting the temperature of the adsorbent at an upper portion of said fuel processing apparatus;

second temperature detecting means for detecting the temperature of the adsorbent at a lower portion of said fuel processing apparatus;

discriminating means for determining the state of the fuel adsorbed onto the adsorbent on the basis of the temperatures detected by said first and second temperature detecting means while said valve means closes said fluid passage, and for determining abnormality of the fuel-purging system on the basis of temperature drop of the adsorbent detected by at least one of said first and second temperature detecting means while said valve means opens said fluid passage after the state of the adsorbed fuel becomes a predetermined state.

6. A fuel-purging system as set forth in claim 5. wherein said valve means opens said fluid passage to perform fuel-purging for a predetermined period of time before said discriminating means determines the state of the fuel adsorbed onto the adsorbent.

* * * * *